United States Patent [19]

Szudarek

[11] 4,071,289

[45] Jan. 31, 1978

[54] ELECTRICAL CONNECTOR ASSEMBLY FOR RIBBON TYPE ELECTRICAL CABLE

[75] Inventor: Robert G. Szudarek, Warren, Mich.

[73] Assignee: Essex Group, Inc., Fort Wayne, Ind.

[21] Appl. No.: 761,506

[22] Filed: Jan. 21, 1977

[51] Int. Cl.[2] ..... H01R 9/12

[52] U.S. Cl. ..... 339/17 F; 339/22 B; 339/176 MF

[58] Field of Search ..... 339/17 F, 22 B, 23, 339/176 MF

[56] References Cited

U.S. PATENT DOCUMENTS

| | | | |
|---|---|---|---|
| 3,015,082 | 12/1961 | Meacham | 339/22 B |
| 3,255,429 | 6/1966 | Forney | 339/176 MF |
| 3,439,309 | 4/1969 | Griger et al. | 339/22 B |

FOREIGN PATENT DOCUMENTS

| | | | |
|---|---|---|---|
| 700,490 | 12/1953 | United Kingdom | 339/17 F |

*Primary Examiner*—Roy Lake
*Assistant Examiner*—Mark S. Bicks
*Attorney, Agent, or Firm*—Lawrence E. Freiburger; Robert D. Sommer

[57] ABSTRACT

An electrical connector assembly for making electrical connections to the flat electrical conductors of ribbon type electrical cable. In the connector assembly of the invention, the insulation is removed from a portion of the ribbon cable so as to expose the flat electrical conductors. The exposed portion of the flat electrical conductors is axially twisted so that the plane defined thereby is substantially perpendicular to the plane defined by the ribbon cable. A housing member encloses the portion of the ribbon cable from which insulation has been removed and supports electrical terminal means which mate with the twisted electrical conductors.

3 Claims, 2 Drawing Figures

ELECTRICAL CONNECTOR ASSEMBLY FOR RIBBON TYPE ELECTRICAL CABLE

BACKGROUND OF THE INVENTION

In the prior art, it is broadly known to terminate flat conductor cable by removing a portion of the insulation from the cable, deforming the exposed conductor lengths to form a desired contact arrangement and applying an insulator to the conductor lengths. For example, see U.S. Pat. Nos. 3,017,602 and 3,258,831. It is also well known in the prior art to apply receptacle type terminals edge-wise to a strip like electrical conductor. See, for example, U.S. Pat. Nos. 3,487,356 and 3,917,371.

It will be seen that the prior art flat conductor cable terminations suffer from a number of disadvantages, such as the requirement of a molded housing on the cable or a complex connector structure which is subject to misalignment.

Thus, the need for a simple, reliable connector for flat conductor type ribbon cable is clear. Desirably, such a connector should be able to terminate the end of a ribbon cable as well as to be able to make an electrical connection to the ribbon cable in the center. Further, the terminals used in such a connector should make contact directly to the cable conductors rather than through an intermediate terminal or conductor so as to increase the reliability of the electrical connection. A further desirable feature for such connectors is that the electrical connection be easily disassembled in the event one or more components does fail.

SUMMARY OF THE INVENTION

It is an object of the present invention to provide an electrical connector for making connections to ribbon type cable having flat electrical conductors. It is a further object of the present invention to provide a connector for making electrical connections to a ribbon type cable which has all the above-noted desirable features.

In summary, in the connector assembly of the invention the insulation is removed from a portion of the ribbon cable and the exposed conductors are twisted axially. A housing member is adapted to enclose the portion of the cable from which the insulation has been removed and to hold electrical terminals in place which are adapted to mate with the axially twisted conductors.

BRIEF DESCRIPTION OF THE DRAWINGS

During the course of the detailed description of the preferred embodiment of the invention, reference will be made to the drawings in which.

DETAILED DESCRIPTION OF THE INVENTION

Figure 1:
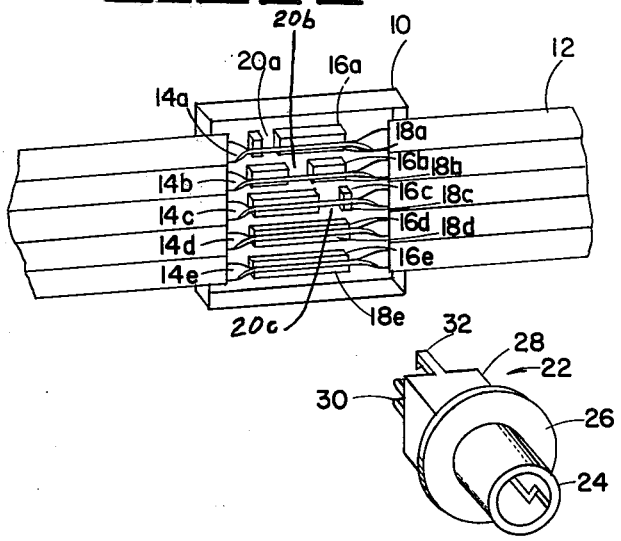
FIG. 1 is a perspective view of a connector assembly in accordance with the present invention in the form of a lamp socket assembly.

Referring now to FIG. 1, a lamp socket connector assembly embodying the principles of the present invention includes an insulative base member 10 which is adapted to receive a ribbon type electrical cable 12 in which the flat electrical conductors 14*a*, 14*b*, 14*c*, 14*d* and 14*e* are axially twisted approximately 90° from their normal orientation. Each flat twisted conductor 14*a*–14*e* is held in its twisted orientation by a channel formed by two upstanding flanges 16 and 18. In the drawing FIGURE the flanges 16 and 18 are identified with a letter suffix to indicate the conductor with which they are associated.

As indicated in the drawing, the flanges 16*a* and 18*a* each have a notch portion 20*a* therein so that a suitable electrical terminal such as a tuning fork type or a double bellow type may be inserted onto the twisted conductor. Similar notches are associated with conductors 14*b* and 14*c* and are indicated by reference numerals 20*b* and 20*c*. The notches 20*a*, 20*b* and 20*c* are staggered longitudinally from one another so that adjacent terminals cannot touch one another. As shown in the drawings, no connection is made to conductors 14*d* and 14*e*, but it will be understood that such a connection can be made, if desired.

A mating female connector assembly 22 is adapted to be resiliently retained on base member 10. As shown in the drawings, the female connector is a lamp socket, but it will be clear to those skilled in the art that it can take other forms as well. The lamp socket includes a lamp receiving portion 24, a collar 26 therearound which locates the socket in mounting, and a terminal retaining portion 28. The terminal retaining portion 28 serves to retain the desired tuning fork type or double bellow type terminals 30 therein in a conventional manner except that the terminals are arranged to cooperate with their respective notches. Only one terminal 30 is shown for sake of convenience and clarity. The terminal retaining portion 28 of lamp socket 22 is latched onto base member 10 by a pair of resilient locking fingers 32, only one of which is shown.

The advantages of the lamp socket connector assembly shown in FIG. 1 should be clear to those skilled in the art, but they will briefly be described in order to ensure that they are completely enumerated. First, the structure of the invention allows for easy field installation. Secondly, the use of tuning fork type or double bellow type of terminal creates a better electrical contact because of the sliding motion during installation as opposed to an abutting contact as in the prior art. Third, the number of contact interfaces between the ribbon cable and the lamp is two whereas in some prior art lamp socket assemblies the number of contact interfaces is three.

Operation of the lamp socket assembly of FIG. 1 will be easily recognized from the drawing FIGURE. Socket assembly 22 is preassembled with terminals 30 being retained therein. Flat ribbon type cable 12 is then stripped of insulation at the desired connection point and is assembled to base member 10 with the twisted conductors 14 located between flanges 16 and 18. To complete the final assembly, the socket assembly 22 is latched in place on the base member 10 with the terminals 30 engaging their respective conductor to make electrical contact thereto.

Figure 2:
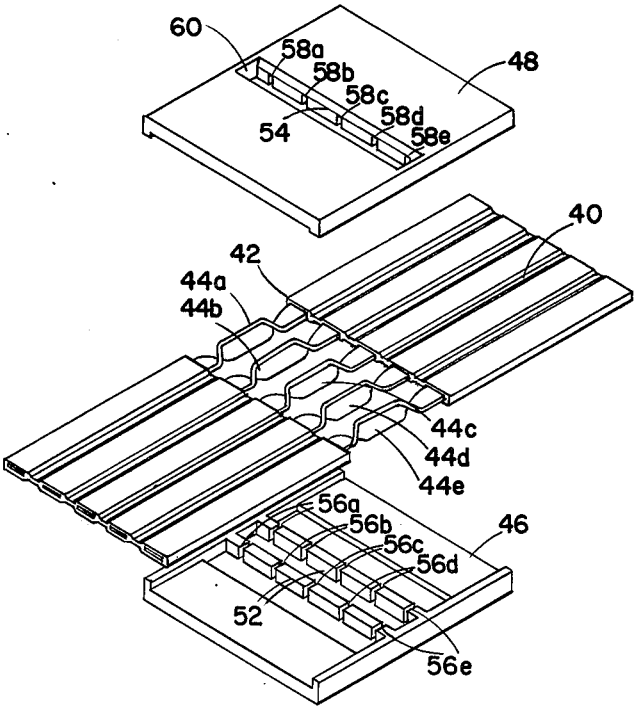
FIG. 2 is a perspective view of a connector assembly in accordance with the present invention in the form of an electrical connector assembly adapted to make a electrical connection between a ribbon cable and one or more individual wires or another ribbon type cable.

Referring now to FIG. 2, a second embodiment of the invention is disclosed which is useful in making an electrical connection between the conductors of a flat conductor cable and another set of electrical connectors. Only one half of the complete connector assembly is shown in FIG. 2, it being understood from the discussion in connection with FIG. 1 that the mating connector will retain a plurality of suitable terminals for making the electrical connection to the ribbon cable conductors such as tuning fork type or double bellow type terminal.

The connector assembly of FIG. 2 includes the ribbon type cable 40 from which a portion of the insulative sheath 42 has been removed to expose the electrical conductors indicated by reference numerals 44*a*–44*e*. The conductors 44*a*–44*e* are normally oriented in the same plane as the ribbon cable but the exposed conductors are axially twisted approximately 90° from their normal orientation in the same manner as the embodiment in FIG. 1.

A connector housing assembly includes a base member 46 and a cover member 48 which mate together to enclose the bared conductors 44*a*–44*e*. If desired, the base 46 and cover member 48 may be identical, thus making connection from either side of the cable possible. However, they may also be formed so that connection from only one side is possible. Both the base and cover members include means for holding the axially twisted conductors parallel to one another in the form of upstanding spaced apart locating flanges 52 on base member and 54 on the cover member, one of which is not depicted in the drawing. It will be seen that the flanges 52 and 54 each have a plurality of slots 56 and 58, respectively, which serve to receive and space the conductors 44*a*–44*e* from one another when the cover and base members are brought into engagement with one another. The slots 56 and 58 have, on the drawing, been identified with a letter suffix in the same manner as the conductors 44.

In assembling the connector of FIG. 2, the base and cover members 46 and 48 are preferably provided with a latching means of some type so that the base 46 and cover 48 may be brought into engagement with one another and assembled to the ribbon cable. A mating connector member (not shown) having a plurality of terminals for attachment to conductors 44*a*–44*e* is then attached to the cover member 48 with the terminals extending through an aperture 60 between flanges 54 in cover member 48. The terminals of the mating connector may, of course, be suitably electrically connected to another set of electrical conductors or other electrical device.

Two embodiments of the present invention have been disclosed for exemplary purposes only. It will be clear to those skilled in the art that the principles and concepts of the present invention may be employed in other devices as well. For this reason it is intended that the invention be defined in the claims.

What is claimed is:

1. An electrical connection assembly, comprising:

an elongated ribbon type electrical cable having a plurality of elongated, flat, coplanar, flexible electrical conductors, and a continuous insulative sheath in intimate contact with and surrounding said flat conductors, an entire intermediate segment of said insulative sheath being removed so as to expose said flat electrical conductors, the exposed portion of said flat electrical conductors being axially twisted so that the plane defined by each such exposed portion is generally perpendicular to the plane defined by said cable;

an insulative base member adapted for cooperation with said ribbon type cable, said base member including means thereon for electrically insulating said twisted conductors from one another;

an insulative cover member adapted to mate with said base member so as to form an enclosure for the exposed portion of said electrical conductors; and electrical terminal means in said cover member and engaging the exposed portion of said electrical conductors for making contact to said electrical conductors.

2. The electrical connection assembly as claimed in claim 1 wherein:

said insulative cover member comprises a lamp socket housing.

3. The electrical connection assembly as claimed in claim 1 wherein said base member and means thereon for electrically insulating said twisted conductors from one another, comprise:

a plastic member having integral upstanding flanges thereon, said flanges defining a plurality of guide slots therebetween;

each said exposed twisted conductor being situated in one of said guide slots.

* * * * *